US007559998B2

(12) United States Patent
Nishibata et al.

(10) Patent No.: US 7,559,998 B2
(45) Date of Patent: Jul. 14, 2009

(54) HOT FORMING METHOD AND A HOT FORMED MEMBER

(75) Inventors: Toshinobu Nishibata, Nishinomiya (JP); Masahiro Nakata, Nishinomiya (JP); Shuntaro Sudo, Toyota (JP); Akira Obayashi, Toyota (JP); Masanobu Ichikawa, Nisshin (JP)

(73) Assignees: Sumitomo Metal Industries, Ltd., Osaka (JP); Toyota Jidosha Kabushiki Kaisha, Aichi (JP); Toyoda Iron Works Co., Ltd., Aichi (JP)

( * ) Notice: Subject to any disclaimer, the term of this patent is extended or adjusted under 35 U.S.C. 154(b) by 339 days.

(21) Appl. No.: 11/287,356

(22) Filed: Nov. 28, 2005

(65) Prior Publication Data

US 2006/0185774 A1 Aug. 24, 2006

Related U.S. Application Data

(63) Continuation of application No. PCT/JP2004/007654, filed on May 27, 2004.

(30) Foreign Application Priority Data

May 28, 2003 (JP) ..... 2003-151106

(51) Int. Cl.
*C22C 38/28* (2006.01)
*C22C 38/32* (2006.01)
*C21D 7/13* (2006.01)

(52) U.S. Cl. ..... 148/330; 148/333; 148/334; 148/335; 148/654; 148/647; 148/649

(58) Field of Classification Search ..... 148/645, 148/660–661, 649, 330–336, 320, 647, 654; 420/104–106, 109, 110, 121
See application file for complete search history.

(56) References Cited

U.S. PATENT DOCUMENTS 4,824,492 A * 4/1989 Wright ..... 148/624
6,248,191 B1 * 6/2001 Luton et al. ..... 148/654

FOREIGN PATENT DOCUMENTS

| | | |
|---|---|---|
| EP | 1 143 029 | 10/2001 |
| GB | 1490535 | 11/1977 |
| JP | 8-260057 | * 10/1996 |

(Continued)

OTHER PUBLICATIONS

English abstract of Japanese patent 404371547, Matsushima, Yoshitake et al., Dec. 24, 1992.*

(Continued)

*Primary Examiner*—Deborah Yee
(74) *Attorney, Agent, or Firm*—Clark & Brody

(57) ABSTRACT

A hot press-formed member having stable strength and toughness is manufactured from a high strength steel sheet by hot press forming. In the cooling stage during hot press forming, the cooling rate is at least the critical cooling rate until the Ms point is reached and it is then in the range of 25-150° C./s in the temperature range from the Ms point to 200° C. The Vickers hardness of the hot pressed member is less than the value of (maximum quenching hardness—10) and at least the value of (maximum quenching hardness—100).

8 Claims, 1 Drawing Sheet

FOREIGN PATENT DOCUMENTS

| | | |
|---|---|---|
| JP | 08-269615 | 10/1996 |
| JP | 2944540 | 6/1999 |
| JP | 2001-353548 | 12/2001 |
| JP | 2002-180186 | 6/2002 |
| JP | 2002-241895 | 8/2002 |
| JP | 2002-309345 | 10/2002 |
| JP | 2003-147499 | 5/2003 |
| WO | WO 03/035922 A1 | 5/2003 |

OTHER PUBLICATIONS

Advanced Materials & Processes, vol. 146, No. 6, Dec. 1994, p. 16.

* cited by examiner

HOT FORMING METHOD AND A HOT FORMED MEMBER

CROSS-REFERENCE TO RELATED APPLICATIONS

This application is a continuation of International Patent Application No. PCT/JP2004/007654, filed May 27, 2004. This PCT application was not in English as published under PCT Article 21(2).

TECHNICAL FIELD

This invention relates to a hot formed member such as a mechanical structural part including a structural part of an automobile body and an automobile suspension part, and to a hot forming method used for its manufacture. More specifically, the present invention relates to a hot press-formed member and a hot press forming method for its manufacture.

Below, the present invention will be explained using hot press forming as an example, but the present invention can also be applied to different types of hot forming other than press forming, such as roll forming and forging.

BACKGROUND ART

In recent years, as a result of the trend towards decreases in the weight of automobiles, efforts have been proceeding at obtaining high strength steel members, such as to achieve a tensile strength of 590 MPa, in order to reduce the weight thereof. Due to this trend, with thin steel sheets which are widely used in automobiles, as the strength of steel sheets has increased, press formability has decreased, and it is becoming difficult to manufacture complicated shapes. Specifically, as the strength of a steel sheet increases, its ductility decreases, and problems occur such as breakage of the sheet in locations undergoing a high degree of working, an increase in springback and wall warp, and a worsening of dimensional accuracy.

Accordingly, with high strength steel sheets and particularly those having a tensile strength of 780 MPa or higher, it is not easy to manufacture parts by means of press forming as a method of cold working. If roll forming is used instead of press forming, it may be possible to perform working on the above-described high strength steel sheets, but roll forming can only be applied to a part having a uniform cross section in the longitudinal direction, so the shapes of parts to which roll forming can be applied are limited.

As disclosed in UK Patent No. 1,490,535, in a hot press forming method in which a heated steel sheet is press formed, since the steel sheet is heated to a high temperature so that the material of the steel sheet softens and becomes highly ductile before forming, the steel sheet in a heated state can be formed into a complicated shape with good dimensional accuracy. In addition, by use of the die cooling technique in which a steel sheet is heated to a temperature in the austenite region before press forming in dies and then rapidly cooling in the dies, it is possible to simultaneously achieve an increase in strength of the steel sheet by martensitic transformation, i.e., by quenching.

However, die cooling in a hot press forming method has the problems that the quenching hardness of the resulting formed member is not inadequate and remains at the level of Hv 400-490 in the case of a 0.2% C steel material, and that the hardness of the formed member extremely varies locally.

*Advanced Materials and Processes*, vol. 146, No. 6, 12/94, page 16 discloses hot press forming technology developed by Plunger, a Swedish company. Die quenching (rapid cooling in dies) from 980° C. is described therein. It is assumed that the die temperature is from room temperature to several tens of degrees C. since there is no description of heating for the dies.

JP 08-269615 A1 discloses a hot rolled steel sheet for rapid quenching which comprises C: 0.18-0.30%, Si: 0.01-1.0%, Mn: 0.2-1.5%, P: at most 0.03%, S: at most 0.02%, sol. Al: at most 0.08%, Cr: 0.1-0.5%, B: 0.0006-0.0040%, N: at most 0.01%, optionally at least one of Cu: at most 0.5%, Ni: at most 0.3%, and Ti: 0.01-0.05%, and a remainder of iron. This steel sheet is given a high strength by high frequency hardening after it is cold worked.

DISCLOSURE OF THE INVENTION

The present invention provides a hot formed member which can be manufactured from a high strength steel sheet by hot forming and which has a stabilized strength and toughness, and it also provides a hot forming method for its manufacture.

More particularly, the present invention provides a hot press-formed member such as a mechanical structural part including a structural part of an automobile body and an automobile suspension part and a hot press forming method used for its manufacture.

According to the present invention, a hot formed member with a stabilized strength and toughness can be manufactured by hot forming in which during cooling after forming, such as during die cooling, the average cooling rate in a temperature region extending downwards from the Ms point (the temperature at which martensite begins to form from austenite) is restricted within certain limits.

In one embodiment, the present invention relates to a hot forming method in which a steel sheet having a steel composition consisting essentially, in mass percent, of C: 0.15-0.45%, Mn: 0.5-3.0%, Cr: 0.1-0.5%, Ti: 0.01-0.1%, B: 0.0002-0.004%, Si: at most 0.5%, P: at most 0.05%, S: at most 0.05%, Al: at most 1%, N: at most 0.01%, one or more of Ni: at most 2%, Cu: at most 1%, Mo: at most 1%, V: at most 1%, and Nb: at most 1%, and a remainder of Fe and unavoidable impurities is heated to a temperature of at least the $Ac_3$ point of the steel and held at that temperature before it is formed into the shape of a finished member. According to the present invention, at the time of cooling from the forming temperature during forming or after forming, quenching is carried out by cooling in such a manner that the cooling rate of the resulting formed member to the Ms point (until the Ms point is reached) is at least the critical cooling rate, and such that the average cooling rate from the Ms point to 200° C. is in the range of 25-150° C./s. In the present invention, the critical cooling rate means the upper critical cooling rate.

In another embodiment, the present invention relates to a hot formed member made from a steel sheet having the above-described steel composition. The hot formed member has a hardness on the Vickers scale after hot forming, the hardness being less than the value of (maximum quenching hardness—10) and not less than the value of (maximum quenching hardness—100).

In a preferred embodiment of the present invention, the hot forming is hot press forming which is carried out using a pair of press forming dies.

According to the present invention, it is possible to manufacture a hot press-formed member having both a stabilized strength and toughness. Accordingly, the present invention greatly contributes to a broadening of the uses for press formed members of high strength steel sheets.

DETAILED DESCRIPTION OF THE INVENTION

Figure 1:
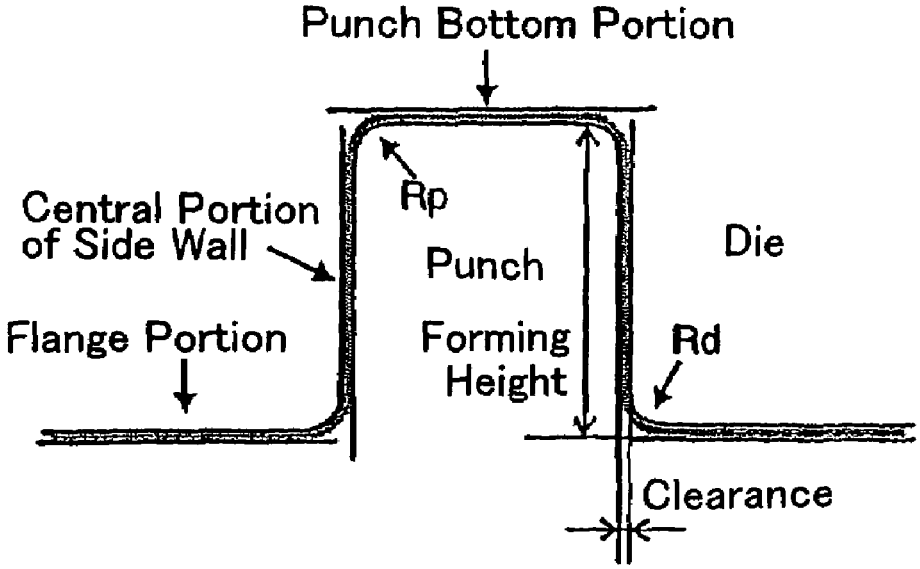
FIG. 1 is a schematic diagram illustrating a hat-shaped forming (deep drawing) method.

The above-described steel composition and forming conditions are employed in the present invention for the following reasons. In the present invention, percent with respect to the steel composition, i.e., the chemical composition of the steel means mass percent.

1. Composition of the Steel Sheet to be Worked

C: 0.15-0.45%

Carbon (C) is an extremely important element because it increases the hardenability of a steel sheet and it primarily determines the strength thereof after hardening. In addition, it is an element which lowers the $Ac_3$ point of a steel and promotes a decrease of the heating temperature required for hardening (quenching). If the C content is less than 0.15%, these effects cannot be achieved adequately, while if the C content exceeds 0.45%, there is a marked decrease in the toughness of hardened portions. Preferably, the lower limit of the C content is 0.16% and the upper limit thereof is 0.35%.

Mn: 0.5-3.0%

Manganese (Mn) is an element which is extremely effective for increasing the hardenability of a steel sheet and stably guaranteeing strength after hardening. In addition, it is an element which lowers the $Ac_3$ point and promotes a decrease in the heating temperature required for hardening. If the Mn content is less than 0.5%, these effects cannot be attained adequately, while an Mn content exceeding 3.0% results in the effects thereof saturating and leads to a decrease in the toughness of hardened portions. A preferred Mn content is 0.8-2.0%.

Cr: 0.1-0.5%

Chromium (Cr) is an element which is effective for increasing the hardenability of a steel sheet and stably guaranteeing strength after hardening. If the Cr content is less than 0.1%, these effects cannot be attained adequately, while if the Cr content exceeds 0.5%, its effects saturate, leading to a needless increase in costs. A preferred Cr content is 0.15-0.30%.

Ti: 0.01-0.1%

Titanium (Ti) is an element which is effective for increasing the hardenability of a steel sheet and stably guaranteeing strength after hardening. In addition, it has the effect of increasing the toughness of hardened portions. If the Ti content is less than 0.01%, these effects are not adequate, while if the Ti content exceeds 0.1%, its effects saturate, leading to a needless increase in cost. A preferred Ti content is 0.015-0.03%.

B: 0.0002-0.004%

Boron (B) is an important element for increasing the hardenability of steel sheets and for further increasing the effect of stably guaranteeing strength after hardening. If the B content is less than 0.0002%, its effects are inadequate, while if the B content exceeds 0.004%, its effects saturate and an increase in costs results. A preferred B content is 0.0005-0.0025%.

Si: at most 0.5%, P: at most 0.05%, S: 0.05%, Al: at most 1%, N: at most 0.01%

Each of these elements also has the effects of increasing the hardenability of a steel sheet and increasing the stability of the strength after hardening. However, if the respective contents exceed the above-described respective upper limits, the effects thereof saturate and lead to an increase in costs.

One or more of Ni: at most 2%, Cu: at most 1%, Mo: at most 1%, V: at most 1%, and Nb: at most 1%

These elements also have the effect of increasing the hardenability of a steel sheet and stably guaranteeing strength after hardening, so one or more of these are included. However, the effects of including them in an amount exceeding the respective upper limits are not significant, and doing so leads to a needless increase in costs, so the contents of these alloying elements are in the above-described ranges.

A steel sheet used in the present invention is heated to a temperature in the austenite region during heating prior to forming, thereby causing austenitic transformation. Therefore, the mechanical properties at room temperature prior to heating are not critical, and there are no particular restrictions on the metallic structure prior to heating. Accordingly, the steel sheet to be worked may be a hot rolled steel sheet, a cold rolled steel sheet, or a plated steel sheet, and there are no particular restrictions on its method of manufacture. Examples of plated steel sheets are aluminum-based plated steel sheets (namely, steel sheets with an aluminum plating or an aluminum alloy plating) and zinc-based steel sheets (namely, steel sheets with a zinc plating or a zinc alloy plating). A plated steel sheet may be either an electroplated steel sheet or a hot dip plated steel sheet. A galvannealed steel sheet may also be used.

2. Heating Conditions and Holding Time

In die cooling at the time of hot press forming, in order to achieve hardening of a formed member, i.e., of a hot press-formed member after forming, it is necessary to initially heat the steel sheet to be worked to a temperature in the austenite region in order to allow the steel sheet to have the structure of an austenite phase. For this purpose, the steel sheet is heated to a temperature of at least the $Ac_3$ point and held at that temperature for a certain period, which is at least 1 minute under usual conditions. There is no particular upper limit on the holding time, but taking into consideration efficiency in actual production, the upper limit on the holding time is preferably on the order of 10 minutes.

3. Cooling Rate at the Time of Hot Press Forming

The cooling rate of a hot press-formed member during hot press forming (while remaining within the dies used for press forming) or after hot press forming (after removal from the dies) is a parameter which performs an extremely important role in obtaining stabilized strength and toughness in the member.

In order to impart stable strength and toughness to a hot press-formed member, it is essential that the structure after hot press forming be not a completely martensitic structure but that it be the structure of auto-tempered martensite. In order to obtain this auto-tempered martensite structure, in the cooling stage during hot press forming or after hot press forming, cooling in the range down to the Ms point is performed at a cooling rate equal to or higher than the critical cooling rate so that diffusional transformation does not take place, and in the subsequent temperature range from the Ms point to 200° C., slow cooling is carried out at an average cooling rate of 25-150° C./s. With such cooling, martensitic transformation and tempering take place simultaneously, so a martensitic structure with minimized variations in strength and excellent toughness is obtained. The average cooling rate from the Ms point to 200° C. is preferably in the range of 30-120° C./s.

4. Forming by Hot Press Forming

The types of forming by a hot press forming method include bending, drawing, bulging, bore expanding, and flange forming. The present invention can also be applied to forming methods other than press forming, such as roll forming, as long as a means is provided for cooling a steel sheet during forming or immediately thereafter.

5. Hot Press-formed Member

A member manufactured by the above-described hot press forming method is a member having a tempered martensitic structure which has minimized variations in strength and excellent toughness. The strength which is obtained is that typical of a tempered martensitic structure, so expressing it as a hardness (Hv), it is lower than the value of (maximum quenching hardness—10) or ("maximum quenching hardness" minus "10"). However, since excessive tempering does not take place, the hardness is at least the value of (maximum quenching hardness—100) or ("maximum quenching hardness" minus "100"). If the value of Hv exceeds the value of (maximum quenching hardness—10), the member has a decreased toughness, while if it is lower than the value of (maximum quenching hardness —100), the member has a decreased strength. A preferred value of Hv is at most the value of (maximum quenching hardness—20) and at least the value of (maximum quenching hardness—80).

The "maximum quenching hardness" used herein is the hardness obtained when a material is held for 10 minutes in a salt bath heated to 900° C. and is then water cooled.

6. Cooling Method at the Time of Hot Press Forming

Normally, a pair of steel dies for use in hot press forming a steel sheet are maintained at room temperature or at a temperature of several tens of degrees C., so at the time of hot press forming, a press formed member is cooled by means of the steel dies. Thus, in order to vary the cooling rate, the dimensions of the dies may be changed to vary their heat capacity.

The cooling rate can also be varied by changing the material of the dies to a different metal (such as copper). When the die dimensions or the material cannot be changed, the cooling rate can be varied by using water-cooled dies and changing the flow rate of cooling water used to cool the dies. In this case, the cooling rate of a press formed member can be varied by, for example, using dies having grooves which are previously cut therein in a plurality of locations and passing water through the grooves while the dies are in a press, or by raising a die in the course of press forming and passing water between the die and the press-formed member.

Accordingly, the following means are conceivable as means for varying the cooling rate across the Ms point during cooling.

(1) Immediately after the Ms point is reached, the material is moved to new dies which have a different heat capacity or which are kept at room temperature to change the cooling rate.

(2) In the cases where water-cooled dies are used, immediately after the Ms point is reached, the flow rate of water which is passed through the dies is varied to change the cooling rate.

(3) Immediately after the Ms point is reached, water is allowed to flow between the dies and the member, and the cooling rate is varied by changing the flow rate of water.

EXAMPLE

The following example illustrates the present invention, but the present invention is in no way limited thereby.

In this example, steel sheets having the compositions shown in Table 1 (sheet thickness: 1.0 mm) were used as steel sheets to be worked. These steel sheets were manufactured from slabs, which were prepared by melting in a laboratory, by hot rolling and subsequent cold rolling. For Steel No. 2, hot dip galvanizing (with a zinc coating weight of 60 g/m$^2$ per side) was applied using a plating simulator, and then alloying heat-treatment (galvannealing) (to an Fe content in the plating film of 15 mass %) was carried out.

After these steel sheets were cut to dimensions of 40 W×60 L (mm), they were heated in a heating furnace in air at 900° C. for 5 minutes. Immediately after they were removed from the heating furnace, hot press forming was carried out thereon using a pair of steel dies each comprising a flat plate. For Steel No. 2, hot press forming was carried out with cooling conditions being varied (Run Nos. 2, 5, and 6).

Measurement of the Vickers hardness (with a load of 9.8 N, 5 measurements) was carried out on the resulting hot press-formed member. The cooling rate after press forming was measured using a thermocouple which was adhered to the steel sheets. The cooling rate was varied primarily by changing the dimensions of the dies.

For Run No. 2, immediately after the temperature of the steel sheet reached the Ms point, water was injected between the dies to adjust the cooling rate.

To determine the maximum quenching hardness, each steel material was held for 10 minutes in a salt bath heated to 900° C. and then subjected to water cooling. The hardness obtained by quenching in this manner was taken as the maximum quenching hardness.

The results which were obtained are shown in Table 2 together with the $Ac_3$ point, the Ms point, and the critical cooling rate, which were measured by the following methods.

Figure 2:
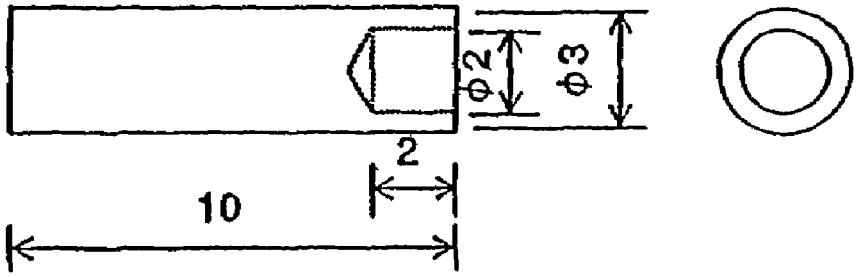
FIG. 2 is a schematic diagram showing the shape of a test piece for measuring the critical cooling rate.

A cylindrical test piece (FIG. 2) having a diameter of 3.0 mm and a length of 10 mm was cut from a hot rolled steel sheet. The test piece was heated in air to 950° C. at a rate of temperature increase of 10° C./s and held for 5 minutes at that temperature, and then it was cooled to room temperature at various cooling rates. By measuring the change in thermal expansion of the test piece during the heating and cooling stages, the $Ac_3$ point and the Ms point were determined. In addition, measurement of the Vickers hardness (with a load of 49 N, 5 measurements) of the resulting test piece and observation of the structure were carried out, and from these results, the critical cooling rate was estimated.

TABLE 1

| Steel | Chemical composition (mass %, balance: essentially Fe) | | | | | | | | | | | | | | |
|---|---|---|---|---|---|---|---|---|---|---|---|---|---|---|---|
| No. | C | Si | Mn | P | S | Cu | Ni | Cr | Mo | V | Ti | Nb | Al | B | N |
| 1 | 0.16 | 0.02 | 1.36 | 0.019 | 0.004 | 0.01 | 0.01 | 0.19 | — | 0.01 | 0.03 | — | 0.06 | 0.0013 | 0.008 |
| 2 | 0.21 | 0.25 | 1.20 | 0.008 | 0.002 | 0.01 | 0.02 | 0.20 | — | 0.01 | 0.02 | 0.01 | 0.05 | 0.0007 | 0.005 |

TABLE 1-continued

| Steel | Chemical composition (mass %, balance: essentially Fe) | | | | | | | | | | | | | | |
|---|---|---|---|---|---|---|---|---|---|---|---|---|---|---|---|
| No. | C | Si | Mn | P | S | Cu | Ni | Cr | Mo | V | Ti | Nb | Al | B | N |
| 3 | 0.33 | 0.11 | 1.53 | 0.001 | 0.001 | — | — | 0.20 | — | — | 0.02 | — | 0.04 | 0.0015 | 0.001 |
| 4 | 0.42 | 0.11 | 1.51 | 0.001 | 0.001 | — | — | 0.20 | 0.01 | — | 0.02 | — | 0.04 | 0.0014 | 0.001 |

TABLE 2

| Run No. | Steel No. | $Ac_3$ point (° C.) | Ms point (° C.) | Critical cooling rate (° C./s) | Measured cooling rate to Ms point (° C./s) | Average cooling rate from Ms point to 200° C. (° C./s) | Hardness after hot press forming (Hv) | Maximum quenching hardness (Hv) | Dimensions of dies (t × W × L mm) | Remarks |
|---|---|---|---|---|---|---|---|---|---|---|
| 1 | 1 | 860 | 450 | 25 | 60 | 40 | 418 | 461 | 50 × 400 × 400 | This |
| 2 | 2 | 823 | 410 | 17 | 60 | 100 | 451 | 501 | 50 × 400 × 400*1 | inven- |
| 3 | 3 | 823 | 390 | 10 | 60 | 40 | 560 | 652 | 50 × 400 × 400 | tion |
| 4 | 4 | 785 | 370 | 10 | 60 | 30 | 683 | 750 | 50 × 400 × 400 | |
| 5 | 2 | 823 | 410 | 17 | 60 | 22*3 | 390 | 501 | 50 × 50 × 400 | Compar- |
| 6 | 2 | 823 | 410 | 17 | 60 | 200*3 | 500 | 501 | 50 × 50 × 400*2 | ative |

*1Immediately after cooling to the Ms point, water was injected between the dies.
*2immediately after cooling to the Ms point, the press was raised and the test piece was directly placed into a water tank.
*3Condition outside the range defined herein.

In Runs Nos. 1-4, which are examples of the this invention, the average cooling rate from the Ms point to 200° C. was suitable, so the resulting hardness was lower than the value of (maximum quenching hardness—10) and higher than the value of (maximum quenching hardness—100).

In Run No. 5, which was a comparative example, cooling was performed at greater than the critical cooling rate, but the average cooling rate from the Ms point to 200° C. was too slow, so sufficient hardness was not obtained. On the other hand, in Run No. 6, which was also a comparative example, the average cooling rate from the Ms point to 200° C. was too fast, so the hardness became too high. Here, the meaning of "too high" for hardness is not that the absolute value of the hardness was too high but that it was close to the maximum quenching hardness.

For the steel sheet of Run No. 2, which was an example of this invention, it was heated at 900° C. for 5 minutes in a heating furnace in air, and after it was removed from the heating furnace, hat-shaped hot press forming (i.e., deep drawing) [blank size: 1.0 t×80 W×320 L (mm)] was performed thereon.

FIG. 1 is a schematic diagram illustrating the hat-shaped press forming method used herein using a pair of dies in the form of a die and a punch. The hot press forming conditions which were used were a forming height of 70 mm, Rd (R of the die shoulder portion) of 8 mm, Rp (R of the punch shoulder portion) of 8 mm, a clearance of 1.0 mm, and a blank holder pressure of 12.7 kN.

The Vickers hardness of the resulting hot press-formed article was measured in various portions thereof including the punch bottom portion, a central portion of the side wall, and the flange portion (with a load of 9.8 N, 5 measurements). In addition, the rate of cooling in each of these portions during cooling was measured by a thermocouple which was adhered to each portion. The results are compiled in Table 3.

TABLE 3

| | Average cooling rate from the Ms point to 200° C. (° C./s) | Hardness after hot press forming (Hv) |
|---|---|---|
| Punch bottom portion | 55 | 460 |
| Center of side wall | 100 | 471 |
| Flange portion | 120 | 480 |

Since the average cooling rate from the Ms point to 200° C. was suitable for each portion, a good hardness was obtained therein. It can be seen that the local variation in the hardness within the same member was minimized.

The invention claimed is:

1. A hot forming method comprising heating a steel sheet having a steel composition consisting essentially of, in mass percent, C: 0.15-0.45%; Mn: 0.5-3.0%; Cr: 0.1-0.5%; Ti: 0.01-0.1%; B: 0.0002-0.004%; Si: at most 0.5%; P: at most 0.050%; S: at most 0.05%; Al: at most 1%; N: at most 0.01%; one or more of Ni: at most 2%, Cu: at most 1%, Mo: at most 1%, V: at most 1%, and Nb: at most 1%; and a remainder of Fe and unavoidable impurities to a temperature of the $Ac_3$ point or higher, holding it at that temperature, and then forming the heated steel sheet to the shape of a finished member, wherein the formed member is quenched by cooling from the forming temperature during forming or after forming in such a manner that the cooling rate to the Ms point is at least the critical cooling rate, and that the average cooling rate from the Ms point to 200° C. is in the range of 25-150° C./s, wherein control of the average cooling rate from the Ms point to 200° C. obtains an auto-tempered martensite structure and a hardness expressed in Vickers hardness being less than the value of (maximum quenching hardness—10) and at least the value of (maximum quenching hardness—100).

2. A hot forming method as set forth in claim 1 wherein the forming is carried out using a pair of press forming dies.

3. A hot forming method as set forth in claim 1 wherein the forming is carried out using a pair of press forming dies and after forming, cooling is carried out by injecting water between the dies.

4. A hot formed member made from a steel sheet having a steel composition consisting essentially of, in mass percent, C: 0.15-0.45%; Mn: 0.5-3.0%; Cr: 0.1-0.5%; Ti: 0.01-0.1%; B: 0.0002-0.004%; Si: at most 0.5%; P: at most 0.05%; S: at most 0.05%; Al: at most 1%; N: at most 0.01%; one or more of Ni: at most 2%, Cu: at most 1%, Mo: at most 1%, V: at most 1%, and Nb: at most 1%; and a remainder of Fe and unavoidable impurities, characterized in that the hot formed member after hot forming and quenching has an auto-tempered martensite structure, and a hardness of the hot formed and quenched member after hot forming and quenching expressed in Vickers hardness is less than the value of (maximum quenching hardness—10) and at least the value of (maximum quenching hardness—100).

5. A hot formed member as set forth in claim 4 wherein the hot forming is hot press forming.

6. A hot forming method as set forth in claim 2 wherein after forming, cooling is carried out by injecting water between the dies.

7. A hot forming method as set forth in claim 2, wherein the cooling from the Ms point is carried out in a manner selected from:

a) the formed member is moved to new dies; or b) a flow rate of water which is passed through the dies is varied to change the cooling rate; or c) water is allowed to flow between the dies and the formed member, and the cooling rate is varied by changing the flow rate of water.

8. A hot forming method as set forth in claim 7 wherein and after forming, cooling is carried out by injecting water between the dies.

* * * * *